US005174234A

United States Patent [19]

Ryan

[11] Patent Number: 5,174,234

[45] Date of Patent: Dec. 29, 1992

[54] BOAT DOCKING SYSTEM

[76] Inventor: Neil Ryan, 1616 W. Olive, Chicago, Ill. 60660

[21] Appl. No.: 716,626

[22] Filed: Jun. 17, 1991

[51] Int. Cl.[5] ..... B63B 21/00

[52] U.S. Cl. ..... 114/230; 114/263

[58] Field of Search ..... 114/263, 230; 405/218-221

[56] References Cited

U.S. PATENT DOCUMENTS

| | | | |
|---|---|---|---|
| 1,300,954 | 4/1919 | Gray | 114/45 |
| 2,662,501 | 12/1953 | Bascome, Jr. | 114/230 |
| 2,744,483 | 5/1956 | Rhindress | 114/45 |
| 3,041,639 | 7/1962 | Atlas | 114/230 |
| 3,155,069 | 11/1964 | Ross et al. | 114/230 |
| 3,442,245 | 5/1969 | Christians et al. | 114/230 |
| 3,556,170 | 1/1971 | Bily | 114/230 |
| 3,603,276 | 9/1971 | De Lisle | 114/45 |
| 3,659,545 | 5/1972 | Hedman | 114/230 |
| 3,951,087 | 4/1976 | Carson | 114/45 |
| 3,967,570 | 7/1976 | Bradfield | 114/45 |
| 3,981,261 | 9/1976 | Kauffman et al. | 114/230 |
| 3,991,695 | 11/1976 | McDonald | 114/45 |
| 4,082,054 | 4/1978 | Bruner | 114/230 |
| 4,276,850 | 7/1981 | Valencia | 114/230 |
| 4,284,026 | 8/1981 | Martinson et al. | 114/230 |
| 4,549,835 | 10/1985 | Ando et al. | 405/4 |

*Primary Examiner*—Edwin L. Swinehart

*Attorney, Agent, or Firm*—Hill, Van Santen, Steadman & Simpson

[57] ABSTRACT

A boat docking system having a V-shaped horizontal floating structure held together by two underwater bents. The structure is constructed of two flexible fiberglass rods which allows the structure to open up and conform to a shape of a boat inserted into the V-shape. The two bents acts as spring clips to open up the V-shape against resilient force, and to thereafter close around the contour of the boat. The V-shape structure is floated intermittently by tubular foam buoys fixed along lengths of the V-shape structure. A strut anchored to the dock at one end and attached to the V-shape structure at another end with a sliding joint gives stability to the floating structure as well as provides the proper distance during docking of the boat to the walkway.

34 Claims, 2 Drawing Sheets

C
60
20a
40
36
44
62a
62
62a
IV
IV
28
26
26
80
10
28
48
32
A 48
80
28
26
20a
44'
32
100
A'

40
36a
28
36
44b
44c
44a
44

BOAT DOCKING SYSTEM

BACKGROUND OF THE INVENTION

The present invention relates to boat docks, and methods for docking boats alongside piers and the like. In particular, the invention relates to a docking system which both guides the boat into the docking area and holds the boat securely a proper distance from the dock or pier for boarding and deboarding.

In most docking arrangements, the captain or operator of the boat must pull into a dock stall alongside the dock or pier and tie his boat to the dock fore and aft before leaving the boat. The captain must be careful when approaching the dock not to bump his boat into the dock but at the same time maintain a close enough distance to the dock so that a passenger in the boat can grab onto the dock to tie off the boat. This system of docking a boat is disadvantageous in that the boat can scrape the dock or bump the dock causing damage. Additionally, the passenger grabbing the dock can loose his balance and fall into the water. Additionally, inconvenient and hectic synchronization and teamwork is required for the captain to approach the dock carefully while at the same time requiring a passenger to grab for ropes and appurtenances on the dock to tie the boat off.

SUMMARY OF THE INVENTION

It is an object of the invention to provide a docking system that enables the captain of the boat to single-handedly launch or dock his boat, reducing the number of hands needed to guide or dock the boat or to set sail. It is an additional object of the invention to provide a system to rapidly dock a boat without exercising great care to approach the dock to avoid damage or prevent passengers from falling into the water. It is a further object of the invention to provide a docking system which enables the captain to exercise less care in his approach due to misalignment of angular approach or being moved off course by wind or wave action. It is a further object of the invention to provide a docking system which holds the boat securely a proper distance away from the dock so that wave action cannot bump the boat up into the dock. It is still a further advantage of the invention that the docking system holds the boat at the water line of the boat which is the strongest area of most boats. It is a further object of the invention to hold a boat securely along many points instead of being tied off at only a few points.

The objects of the invention are achieved in that a boat docking system is provided which enables the captain to guide his boat into the docking area with a minimum of care and forethought. The boat docking system of the present invention is forgiving as to angular approach of the boat into the dock area. The boat docking system of the present invention provides a guiding and holding system which holds the boat a proper distance from the dock, holding the boat along many points along the sides of the boat instead of merely a few points. The boat docking system of the present invention provides a secure holding means for holding the boat a proper distance from the dock and is resistant to dislocation of the boat into the dock during strong waves or wind. The boat docking system of the present invention holds the boat along the boat's water line which is the strongest area of most boats.

The boat docking system of the present invention is an inexpensive and readily manufacturable arrangement to provide an efficient means of docking boats of a plurality of variable sizes.

DETAILED DESCRIPTION OF THE PREFERRED EMBODIMENTS

Figure 1:
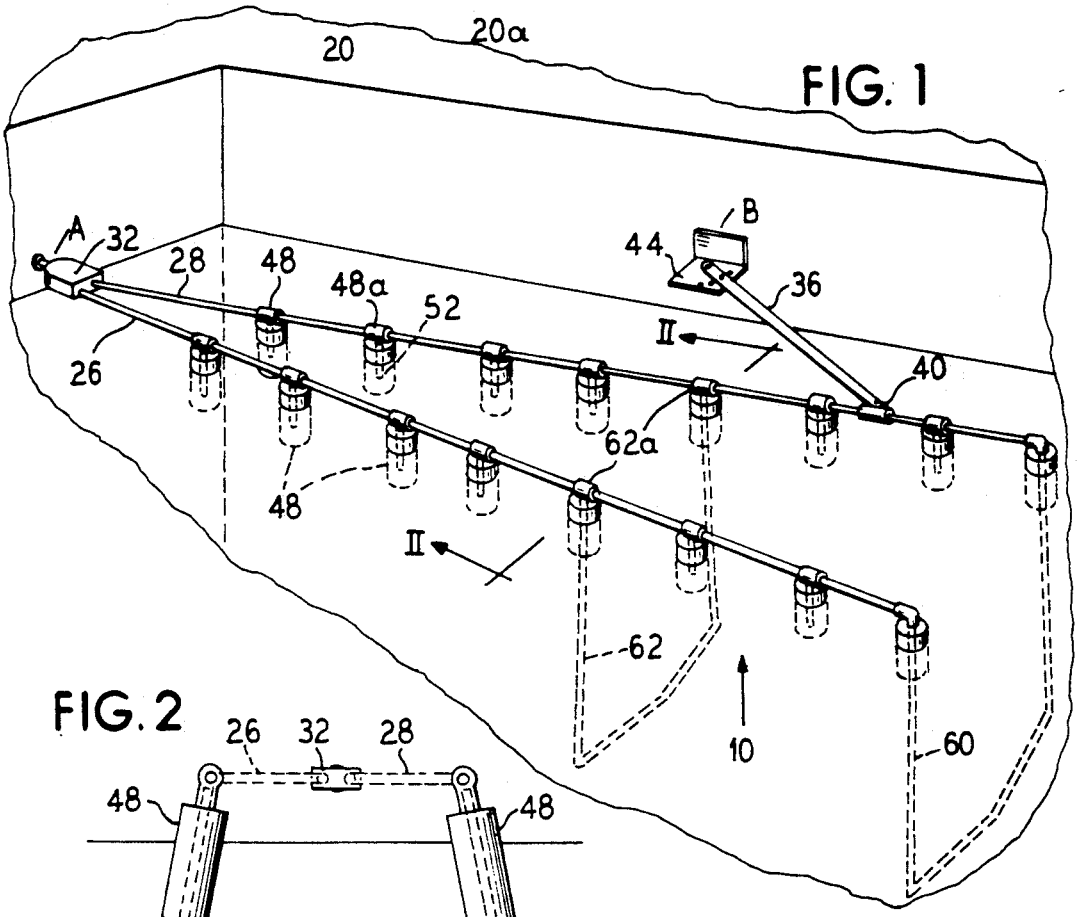
FIG. 1 is a perspective view of the boat docker of the present invention.

FIG. 1 shows a boat docking system, herein referred to as "boat docker" generally at 10. The boat docker 10 is anchored at two locations, A, B, to an L-shaped docking structure 20.

The boat docker 10 comprises a first longitudinal rod 26 and a second longitudinal rod 28 anchored to the structure 20 at point A by an apex joint 32 which is itself anchored to the structure 20. The second longitudinal rod 28, which is the rod 28 nearest to a lateral walkway **20*a* of the structure 20 is anchored to the walkway 20*a* by a strut 36. The strut 36 is connected to the second longitudinal rod 28 by a slide joint 40 and to the walkway 20*a* by an adjustable lug 44. By using the slide joint 40 the strut can proceed along the length of the second longitudinal rod 20*a* but cannot be separated from the second longitudinal rod. Arranged intermittently along the first and second longitudinal rods 26, 28 are a plurality of buoys 48 which float the first and second longitudinal rods. The buoys 48 can be fixed at points along the longitudinal rods 26, 28 or can utilize slide-type joints for ease of assembly and disassembly and adjustment in the water. The slide joints are noted at 48*a*. The slide joint 48*a* is hollow tubular in cross section; the slide joint 48*a* is pushed over the rod 26, 28 during assembly. Extending at a right angle from the slide joint 48*a* is a spindle piece 52 which extends down into an aperture formed through the buoy 48 in a relatively tight fitting manner. In an exemplary embodiment the buoys 48** are cylindrical buoys having the longitudinal aperture therethrough.

Figure 2:
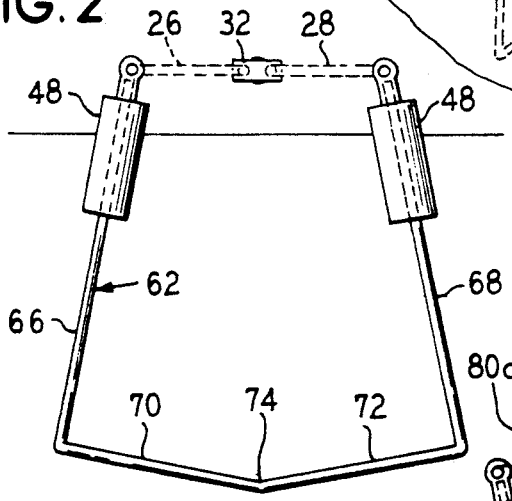
FIG. 2 is a sectional view taken generally along line II—II of FIG. 1.

Located at at least one point along the longitudinal rods 26, 28 and preferably along two locations are retaining bents 60, 62 arranged perpendicular to the plain of the water line and extending down into the water. The first bent 60 is arranged at the outermost point of the longitudinal rods 26, 28 away from the apex joint 32. The second bent 62 is located inward from the first bent 60 along the length of the longitudinal rods 26, 28. The second bent 62 is shown more clearly in FIG. 2. It is formed of a first generally vertical leg 66 and a second generally vertical leg 68 connected below water by a first bottom leg 70 and a second bottom leg 72, connected together at a bottom point 74. The second bent 62 thus forms a U-shape with a kinked bottom portion. The first vertical leg 66 and the second vertical leg 68 form approximate right angles with the first bottom leg 70 and the second bottom leg 72 respectively. The first vertical leg 66 and the second vertical leg 68 are, when relaxed, that is, no boat residing within the longitudinal rods 26, 2, actually inclined upwardly toward each other.

Although in the exemplary embodiment the two bents 60, 62 are shown U-shaped having a kinked bottom leg; plain U-shaped bents or squared L-shaped bents can be used, i.e., U-shaped bents having a straight bottom and upstanding legs. This latter form is particularly advantageous when the bents are shallow, for example, for a boat without a keel.

Figures 3, 5, 6:
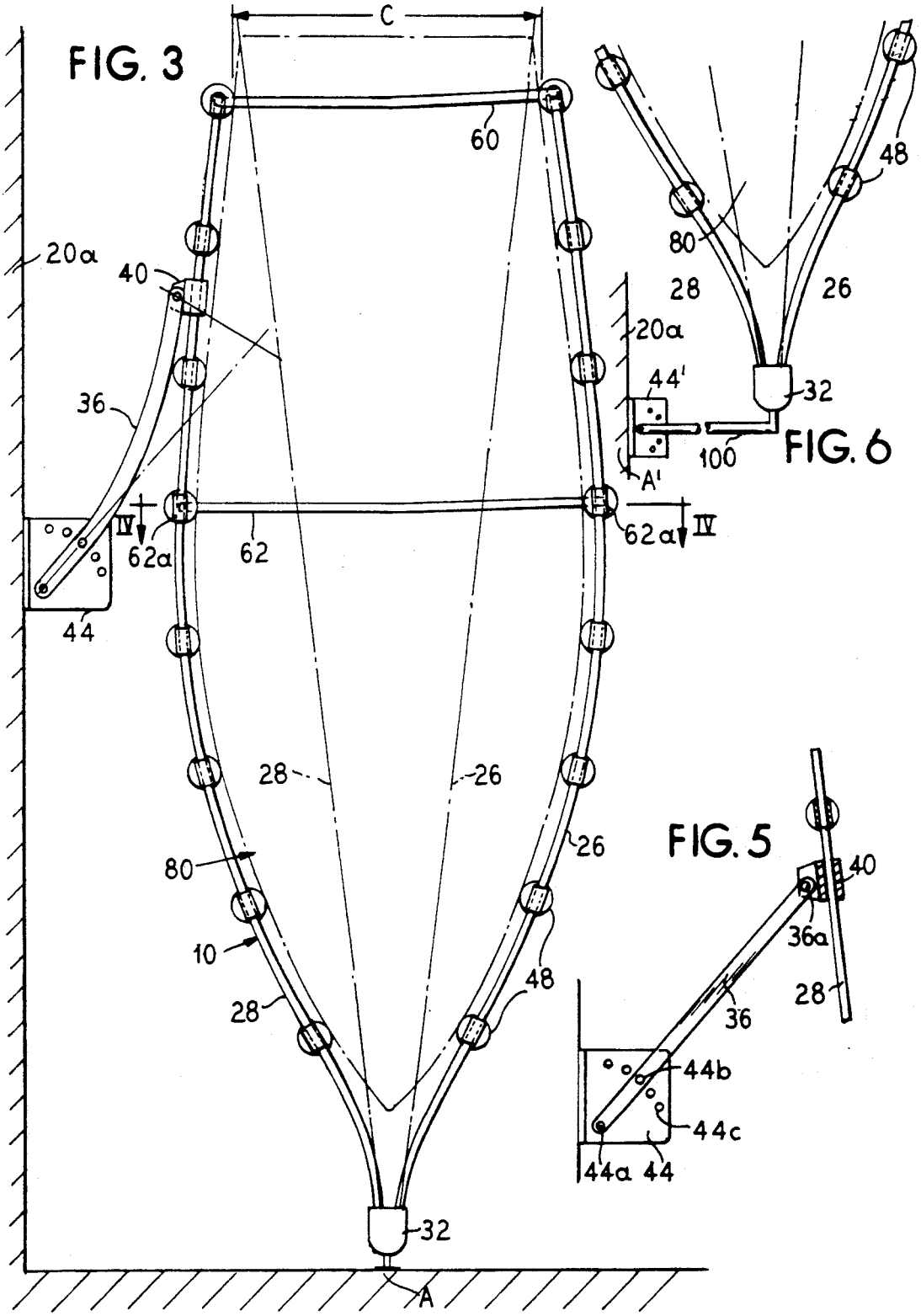
FIG. 3 is a plan view of the boat docker of FIG. 1 with a boat residing therein.
FIG. 5 is an enlarged plan view of a portion of the boat docker of FIG. 1.
FIG. 6 is a partial plan view at an alternate attaching arrangement for the boat docker.

FIG. 3 shows the boat docker 10 holding a boat shown in phantom at 80 docked within the docker 10. It is clear from FIGS. 1 and 3 that the boat docker longitudinal rods 26, 28 form a V-pattern when relaxed, but when a boat is docked within the longitudinal rods 26, 28, flex to conform around the shape of the boat 80. The original orientation of the rods 26, 28 is shown dashed in FIG. 3. As the boat 80 forces apart the longitudinal rods 26, 28 the strut 36 flexes toward the walkway 20*a* and the slide joint 40 proceeds along the length of the second longitudinal rod 28. The first and second bents 60, 62 spread apart in resilient fashion to allow passage of the boat into the boat docker 10. The first bent 60, after passage of the boat into the docker 10, conforms to a clear horizontal spacing C which is smaller than the maximum width of the boat, due to the boat's shaping. Thus the first bent 60 retains the boat inside the boat docker 10. That is, in order for the boat 80 to proceed horizontally out of the boat docker the spring force of the first bent 60 must be overcome, the first bent 60 must be spread apart for the boat to leave the boat docker.

Figure 4:
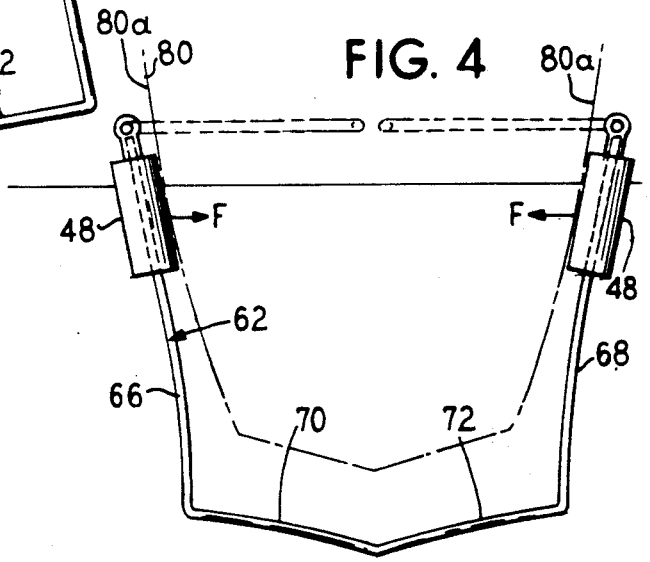
FIG. 4 is a sectional view taken generally along line IV—IV of FIG. 3.

FIG. 4 shows the assumed configuration of the second bent 62 with a boat residing within the boat docker 10. The first vertical leg 66 has assumed a slightly outwardly curved profile, as has the second vertical leg 68. The first bottom leg 70 and the second bottom leg 72 have assumed an outward and downward curvature also. In this configuration, the bent 62 exerts a spring force F through the buoys 48 against side walls 80*a* of the boat 80. The boat is, in effect, resiliently clamped at the first and second bents 60, 62 as well as along the first and second longitudinal rods 26, 28, both by the resilient nature of the first and second rods 26, 28 as well as the assistance of the first and second bents 60, 62. Generally, both bents 60, 62 perform in identical fashion. Also, although one bent or plurality of bents greater than two could be used between the horizontal rods 26, 28, in the exemplary embodiment two such bents 60, 62 are used.

FIG. 5 shows an enlarged view of the strut 36 and associated hardware. The slide joint 40 is shown to be generally a hollow cylinder surrounding the second rod 28 and allowing for movement along the length of the second rod 28. The strut 36 is pinned at 36*a* to the sliding joint 40. The adjustable lug 44 is pinned or bolted at a first point 44*a*, and can be bolted at a second point 44*b* chosen from a number of possible bolt holes 44*c* arranged aligned along a swing of the strut 36 from the first point 44*a*. By adjusting the orientation of the strut 36 the boat can be made to park closer or further away from the walkway 20*a*, and adjustments can be made for sizing an overhang of the boat normally housed in the boat docker 10.

FIG. 6 shows an alternate embodiment of the attachment of the boat docker 10 at point A. This alternate location shall be designated A'. Where an L-shaped dock arrangement is not available, and the boat must be docked alongside a lateral dock only, a lateral strut 100 attaches to the apex joint 32 at one end and to an adjustable lug 44' at its opposite end. The lug 44' is attached in some fashion to the dock lateral walkway 20*a*.

In the preferred embodiment, both the longitudinal rods 26, 28 and the bents 60, 62 are fiberglass rods capable of assuming the flexed configurations. The floats are preferably tube-shaped buoys or rollers made from Dow Ethefoam, a closed cell foamed material.

The connections at 62*a* are preferably fixed connections, fixing the bents 62 with the longitudinal rods 26, 28 but such is not a strict requirement. The connections at 60*a* are L-connections such as used in piping and are fixed connections.

Although the present invention has been described with reference to a specific embodiment, those of skill in the art will recognize that changes may be made thereto without departing from the scope and spirit of the invention as set forth in the appended claims.

I claim as my invention:

1. A boat docking system for guiding and holding a boat at a dock structure, comprising:

a first rod arranged horizontally;

a second rod arranged horizontally;

at least one of said first and second rods connected at a base end to the dock structure;

said first and second rods provide free ends forming an open passage for a boat to be floated therebetween, said first and second rods having a relaxed clear distance at one place smaller than a width of the boat, said first and second rods having a selected cross section to have sufficient flexibility to resiliently bend along their length to open said clear distance at said one place to accept the boat held therebetween as the boat is floated between said first and second rods; and means for urging said first and second rods together, said means located along the length of said rods at a distance from said base end.

2. The boat docking system according to claim 1, wherein said first and second rods are held slightly above water level by a plurality of floats connected to said first and second rods and arranged intermittently along said first and second rods.

3. The boat docking system according to claim 2, wherein said first and second rods are connected to said dock structure at an apex and together form a V-shape openable to conform around the boat sailed thereinto.

4. The boat docking system according to claim 3, wherein said means for urging comprises at least one U-shaped bent arranged vertically and connecting together said first and second rod.

5. The boat docking system according to claim 4, wherein said U-shaped bent comprises a kinked bottom leg.

6. A boat docking system for holding a boat at a dock structure, comprising:

a first rod arranged horizontally;

a second rod arranged horizontally;

said first and second rods connected to the dock structure; and said first and second rods are arranged forming a passage for a boat to be floated therebetween, said first and second rods having sufficient flexibility to resiliently bend along their length away from each other to accept the boat held therebetween as the boat is floated between said first and second rods;

wherein said first and second rods are held slightly above water level by a plurality of floats connected to said first and second rods and arranged intermittently along said first and second rods;

wherein said first and second rods are connected to said dock structure at an apex and together form a V-shape openable to conform around the boat sailed thereinto;

wherein said first and second rods are connected together by at least one U-shaped bent arranged vertically;

wherein said U-shaped bent comprises a kinked bottom leg;

wherein said U-shaped bent comprises a first vertical leg, a second vertical leg, and said kinked bottom leg comprises a first bottom leg portion, and a second bottom leg portion, said first vertical leg connected to said first bottom leg portion at a right angle, said second vertical leg connected to said second bottom leg portion at a right angle, and said first bottom leg portion connected to said second bottom leg portion at an obtuse angle.

7. The boat docking system according to claim 6 further comprising a strut assembly, said strut assembly comprising attachment means for anchoring one end of the strut assembly to the dock structure and second attaching means for connecting the strut assembly at a second end to said second rod.

8. The boat docking system according to claim 7, wherein said second attaching means comprises a sliding joint enabling the strut assembly to retain said second rod but allowing sliding movement therealong.

9. The boat docking system according to claim 8, wherein said first attaching means comprises an adjustable lug having a plurality of bolting arrangements to allow the strut assembly to be adjusted to varying angular orientations.

10. The boat docking system according to claim 9, wherein said floats are tubular shaped extending downward into the water longitudinally.

11. The boat docking system according to claim 3 further comprising a strut assembly, said strut assembly attached to said dock structure at one end, and attached to said second rod at an opposite end.

12. A boat docking system for holding a boat at a dock structure, comprising:

a first rod arranged horizontally;

a second rod arranged horizontally;

said first and second rods connected to the dock structure; and said first and second rods are arranged forming a passage for a boat to be floated therebetween, said first and second rods having sufficient flexibility to resiliently bend along their length away from each other to accept the boat held therebetween as the boat is floated between said first and second rods;

wherein said first and second rods are held slightly above water level by a plurality of floats connected to said first and second rods and arranged intermittently along said first and second rods;

wherein said first and second rods are connected to said dock structure at an apex and together form a V-shape openable to conform around the boat sailed thereinto; and a strut assembly, said strut assembly attached to said dock structure at one end, and attached to said second rod at an opposite end;

wherein said strut assembly is attached to said second rod using a sliding joint enabling the strut assembly to retain said second rod, but allowing sliding movement therealong.

13. The boat docking system according to claim 1, wherein said means for urging comprises at least one U-shaped bent having two generally vertical legs each leg connected to one of said first and second rods and extending down into the water.

14. A boat docking system for holding a boat at a dock structure, comprising:

a first rod arranged horizontally;

a second rod arranged horizontally;

said first and second rods connected to the dock structure; and said first and second rods are arranged forming a passage for a boat to be floated therebetween, said first and second rods having sufficient flexibility to resiliently bend along their length away from each other to accept the boat held therebetween as the boat is floated between said first and second rods;

wherein said first and second rods are held slightly above water level by a plurality of floats connected to said first and second rods and arranged intermittently along said first and second rods;

wherein said first and second rods are connected to said dock structure at an apex and together form a V-shape openable to conform around the boat sailed thereinto;

wherein said first and second rods are connected together by at least one U-shaped bent having two generally vertical legs and extending down into the water;

wherein said one U-shaped bent extends through two tubular-shaped floats, one tubular-shaped float surrounding each generally vertical leg of the U-shaped bent.

15. The boat docking system according to claim 14, wherein said at least one U-shaped bent comprises two U-shaped bents, a first U-shaped bent located at the distal end of said first and second rods, and a second U-shaped bent located between said first U-shaped bent and said apex.

16. The boat docking system according to claim 15, wherein said U-shaped bent comprises in a relaxed state a first bottom leg, and a second bottom leg, one of said generally vertical legs connected to said first bottom leg at a right angle, another of said generally vertical legs connected to said second bottom leg at a right angle, and said first bottom leg connected to said second bottom leg at an obtuse angle.

17. The boat docking system according to claim 16 further comprising a strut assembly, said strut assembly comprising attachment means for anchoring one end of the strut assembly to the dock structure and second attaching means for connecting the strut assembly at a second end to said second rod.

18. The boat docking system according to claim 17, wherein said second connecting means comprises a sliding joint enabling the strut assembly to retain said second rod but allowing sliding movement therealong.

19. The boat docking system according to claim 18, wherein said first attaching means comprises an adjustable lug having a plurality of bolting arrangements to allow the strut assembly to be adjusted to varying angular orientations.

20. A boat docking system for holding a boat at a position in water, comprising:

a first rod arranged horizontally;

a second rod arranged horizontally;

said first and second rods arranged spaced apart forming a channel therebetween, said channel defining a back end and an opposite open end between adjacent ends of said first and second rods, said first and second rods having a selected cross section to have sufficient flexibility to resiliently bend along their length to conform concavely around a boat profile, said rods arranged and configured to have a horizontal clear distance therebetween at least at one location along a length of said channel smaller than a width of a boat to be held therein; and means for urging said first and second rods together at said open end, said means connected to said first and second rods.

21. The boat docking system according to claim 20 further comprising a second means for urging said first and second rods together arranged along the length of said rods between said open end and said back end.

22. The boat docking system according to claim 21, wherein said second means for urging comprises a U-shaped frame having legs arranged vertically with each leg connected to one each of said first and second rods, said first means for urging and said second means for urging arranged at least partially submerged in the water.

23. The boat docking system according to claim 20, wherein said means for urging comprises a frame having first and second portions resiliently spreadable, said first and second portions connected to one each of said first and second rods.

24. The boat docking system according to claim 20, wherein said first and second rods are connected to the dock structure at an apex at said back end and together form a horizontal V-shape, and said first and second rods are supported above the water by a plurality of floats arranged along the length of the first and second rods.

25. A boat docking system for holding a boat having a tapering rear portion at a position in a body of water, comprising:

a frame structure defining an open end and an enclosed space and a length proceeding from said open end inwardly, said length selected to hold a substantial length of a boat floated thereinto; and said frame structure providing an openable resilient clamp means which is spreadable to permit entry of the boat into said frame structure and which resiliently contracts to grasp said tapering trailing portion of the boat held therein to prevent retraction of the boat from the frame structure.

26. The boat docking system according to claim 25, wherein said frame structure comprises two horizontal rods arranged above a water line, supported by a plurality of floats; and said clamping means comprises a subframe having two legs, one of each connected to said horizontal rods, said subframe configured for said legs to be resiliently spreadable from a relaxed distance between each other.

27. The boat docking system according to claim 26, wherein said subframe comprises a U-shape.

28. The boat docking system according to claim 26, wherein said horizontal rods are arranged in a V shape.

29. A boat docking system for guiding a boat at a dock structure, comprising:

a first guide rod arranged horizontally along a first direction and connected at one end to the dock structure;

a strut assembly, said strut assembly attached at one end to a first position the dock structure, and attached at an opposite end to the first guide rod at a second position on the first guide rod a distance from said first position, said first guide rod configured with a cross section and said first and second position spaced apart to provide sufficient bending flexibility of the first guide rod whereby a boat pressing the first guide rod between said first and second positions from an angle to said first direction resiliently deflects the first guide rod, resilient rebound force of the first guide rod causing said boat to change course from said second direction to said first direction.

30. The boat docking system according to claim 29, wherein said first guide rod is supported along its length by a plurality of floats intermittently spaced and proceeding laterally of said first guide rod on a side of said first guide rod opposite said strut assembly, said floats abuttable against a side of the boat arranged along said first direction.

31. The boat docking system according to claim 29, wherein the attachment between the strut assembly and the first guide rod is a sliding connection, and said strut assembly comprises a resilient rod between said dock structure and said sliding connection.

32. The boat docking system according to claim 29 further comprising a second guide rod arranged horizontally and laterally spaced from said first guide rod, said second guide rod resiliently connected to said first guide rod, said second rod comprising a cross section selected for said second guide rod to have sufficient resilient flexibility to redirect a boat impacting said second guide rod from a third direction to said first direction.

33. The boat docking system according to claim 32, wherein said second guide rod is resiliently attached to said first guide rod by a submerged vertical U-shaped frame having upstanding legs connected one each to said first guide rod and said second guide rod.

34. The boat docking system according to claim 33, wherein said second guide rod is connected to said dock structure approximately at the same location as said first guide rod, and said first guide rod and said second guide rod form a horizontal V-shape.

* * * * *